US005528211A

United States Patent [19]

Perreaut et al.

[11] Patent Number: 5,528,211

[45] Date of Patent: Jun. 18, 1996

[54] MAGNETIC FOCUSING DEVICE

[75] Inventors: Jean M. Perreaut, Dijon; Bruno F. Roussel, Genlis, both of France

[73] Assignee: Thomson Tubes and Displays, S.A., France

[21] Appl. No.: 351,723

[22] Filed: Oct. 21, 1994

Related U.S. Application Data

[63] Continuation of Ser. No. 1,104, Jan. 6, 1993, abandoned.

[30] Foreign Application Priority Data

Jan. 10, 1992 [EP] European Pat. Off. ..... 92400069

[51] Int. Cl.[6] ..... H01F 1/00; H01F 7/00; H01J 29/70; H01J 29/46

[52] U.S. Cl. ..... 335/296; 335/210; 313/431; 313/442; 315/5.35; 315/382.1

[58] Field of Search ..... 335/210, 211, 335/212, 213, 214, 296; 313/431, 433, 442; 315/5.35, 382.1

[56] References Cited

U.S. PATENT DOCUMENTS

| | | | |
|---|---|---|---|
| 2,372,443 | 4/1942 | Marton | 313/442 |
| 2,431,077 | 11/1947 | Poch | 313/431 |
| 2,718,606 | 9/1955 | Zuerker | 335/210 |
| 2,729,748 | 1/1956 | Robinson | 313/431 |
| 2,822,528 | 2/1958 | Janssen | 313/431 |
| 3,230,415 | 8/1962 | Kratochvil et al. | 313/442 |
| 3,296,570 | 1/1967 | Uetake | 313/431 |
| 3,371,206 | 2/1965 | Kakizawa | 313/431 |
| 4,642,527 | 2/1987 | Takahashi et al. | 313/431 |
| 4,714,908 | 12/1987 | Watabe | 335/212 |
| 4,758,762 | 7/1988 | Van Gorkum | 313/440 |
| 4,758,813 | 7/1988 | Holsinger | 335/306 |
| 4,896,071 | 1/1990 | Pons | 313/428 |
| 5,113,162 | 5/1992 | Umehara | 335/210 |
| 5,124,613 | 6/1992 | Park | 313/440 |

FOREIGN PATENT DOCUMENTS

| | | | |
|---|---|---|---|
| 0249294 | 12/1987 | European Pat. Off. . | |
| 0250027 | 12/1987 | European Pat. Off. . | |
| 758547 | 5/1953 | Germany . | |
| 55-155448 | 12/1980 | Japan | 313/431 |
| 2085698 | 4/1982 | United Kingdom . | |

*Primary Examiner*—Leo P. Picard
*Assistant Examiner*—Stephen T. Ryan
*Attorney, Agent, or Firm*—Joseph S. Tripoli; Joseph J. Laks; Harvey D. Fried

[57] ABSTRACT

A focusing device for a cathode ray tube comprises a plurality of substantially cylindrical permanent magnets, each having a longitudinal axis. A holder positions the magnets in an annular array at substantially equally spaced intervals in which the axes are substantially parallel to one another. Annular flanges of high magnetic permeability are disposed over longitudinally opposite ends of the magnets. First and second annular windings are symmetrically disposed substantially adjacent to and inwardly from the array of magnets. The magnetic mass of the focusing device can be varied by changing the number of magnets and/or the length of the magnets in the array. The magnets are magnetized in situ in the array by energizing a winding common to each of the magnets, after which the common winding is removed.

4 Claims, 1 Drawing Sheet

MAGNETIC FOCUSING DEVICE

This is a continuation of application Ser. No. 08/001,104 filed on Jan. 6, 1993, now abandoned.

BACKGROUND OF THE INVENTION

1. Field of the Invention

This invention relates to the field of focusing devices for cathode ray tubes, and in particular, to an electromagnetic focusing device utilizing permanent magnets.

2. Description of Related Art

Two general types of magnetic focusing devices are now used. One type of focusing device uses a winding for generating the magnetic field, often referred to as dynamic focusing. The other type of focusing device combines permanent magnets and adjustment windings. These two systems have advantages and disadvantages:

A typical example of the type of focusing device 8 using a winding is shown in FIG. 1. The magnetic field 10 necessary for focusing the electron beam 12 on a screen 9 is produced by an annular winding or coil 14 enclosed in a frame 16. The annular frame 16 has an annular opening or gap 18 which substantially confines the field 10 within the boundary of the winding 14 and frame 16. The focusing point varies if the magnetic center of the field exhibits any hysteresis. Accordingly, the frame 16 is made from extra pure iron to avoid this hysteresis and assure that the same magnetic field will be generated at each start-up.

Focusing is obtained by adjustment of the direct current in the coil. The power brought into play is high, for example on the order of 10 watts for a cathode ray tube taken as reference and powered at a level of 25 kV. The power requirements, especially in connection with projection tubes, can range as high as about 40 kV. At this voltage level, the same focusing coil on the same tube will require about 16 watts. This power provides only the static focusing. It is often desirable to add a supplementary winding (not shown) to obtain dynamic focusing (focusing in the corners of the tube). Dynamic focusing presents two problems in particular. Firstly, high frequency operation, for example 64 KHz, results in very great energy dissipation. Secondly, there is considerable magnetic coupling with the static winding.

A focusing device having a static magnetic field generator can utilize a toroidal permanent magnet made of a material of high thermal stability. Such a magnet solves the problem of dissipated power in the static winding. The focusing adjustment is made by means of an auxiliary winding, having only a small number of turns. This winding dissipates energy at a power level which is negligible as compared to the energy dissipated by a focusing device with fully dynamic coil. Coupling to the dynamic focusing device is also reduced, due to the smaller number of turns.

Although this system works, it too has some disadvantages. Firstly, the magnetic field is not uniform. The material of which the permanent magnet is made is sintered and is not perfectly homogeneous. This lack of homogeneity leads to magnetic field anomalies which create poles. These poles cause spot deformation to appear, such as astigmatism which can result from 4 poles, and coma which can result from 6 poles. The permanent magnet can be implemented as a plurality of discrete permanent magnets, as shown in U.S. Pat. No. 4,758,762. Eight bar magnets, each surrounded by a coil, are disposed in a radial, coplanar array for generating a static focusing field.

Secondly, is the problem of adapting the system to different tubes. The power of the focusing device is proportional to the magnetic mass of the magnet. Therefore, as the magnet must be magnetized to saturation in order to avoid any risk of demagnetization, it is suitable only for a value of high acceleration voltage of the cathode tube. In fact, the required power of the focusing device varies with the acceleration voltage of the tube. This makes it necessary to have several types of magnets for adapting to various tubes, which results in high tooling costs.

SUMMARY OF THE INVENTION

This new focusing device is also based on the use of permanent magnets of high thermal stability. The difference from the classic systems comes from the use, not of a single magnet, but an assembly of several cylindrical magnets held between two flanges of high magnetic permeability, in an annular configuration. The proper positioning of these magnets is ensured by a non-magnetic support piece.

The magnetic mass is advantageously distributed more uniformly than has been possible before now, and the impact of any non-uniformity of the material is thereby substantially reduced.

The magnets are magnetized in situ, after assembly, by an auxiliary magnetizing winding wound around each and every magnet. The magnets are magnetized to saturation by a capacitive discharge into the auxiliary winding on the order of 4,000 amp-turns. This procedure ensures that the same magnetic field value will be established for each magnet, because the current flowing through the auxiliary winding is the same for each magnet and produces the same magnetic field. The auxiliary magnetizing winding can be removed after the magnets have been magnetized as required. Focusing devices can be made in accordance with the invention which have few defects such as astigmatism and coma (resulting from a high number of poles, for example greater than 6).

In accordance with another advantage of the invention, the magnetic mass can be varied easily because the magnetic mass comprises a plurality of magnets. The problem of adapting the assembly to different tubes and different voltages is solved by varying the number of magnets, the length of the magnets, or both. The design of the focusing device can easily be optimized as a function of the stresses and characteristics demanded.

In fact, static focusing can be achieved only in the center of a flat screen, due to the non-sphericity of the screen. A parabolic current permits adjusting the focusing on the entire screen. Additional auxiliary windings can be utilized to permit optimum adjustment of the focusing device on the screen and to enable dynamic focusing.

DETAILED DESCRIPTION OF THE PREFERRED EMBODIMENTS

Figure 1:
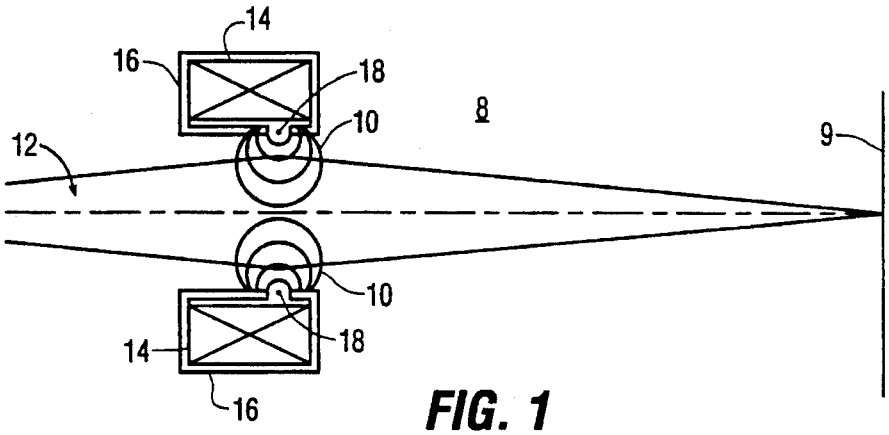
FIG. 1 PRIOR ART
FIG. 1 is a diagram useful for explaining the general principles of electromagnetic focusing.
Figure 3:
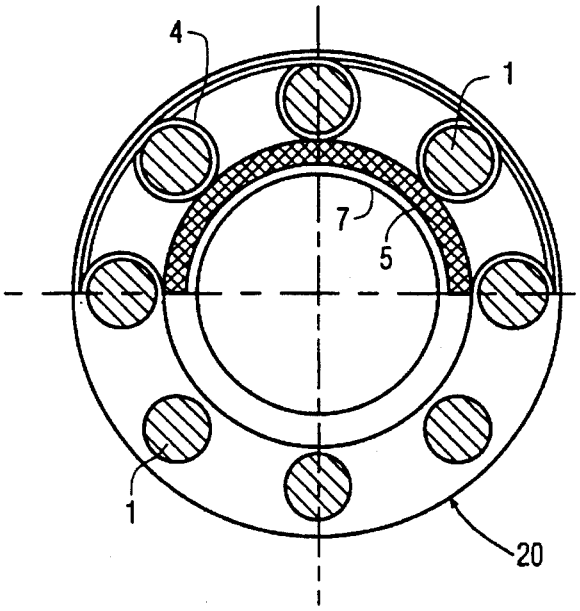
FIG. 3 is a section view taken along the line III—III in FIG. 2.
Figure 2:
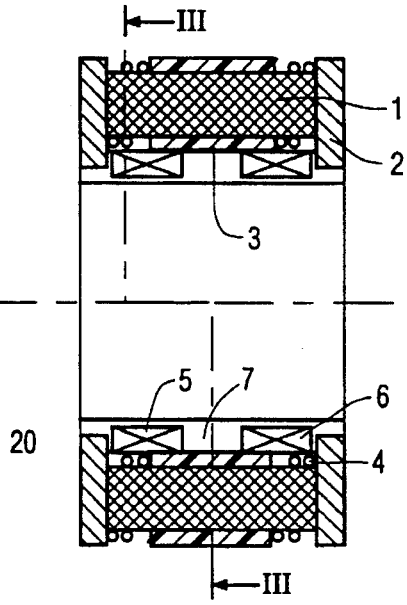
FIG. 2 is a section view of a static focus assembly according to an aspect of the invention.

A focusing device 20 according to the invention is shown in FIGS. 2 and 3. FIG. 2 is a side elevation, in section. The generally annular form of the focusing device 20 is apparent from FIG. 3, which is taken along the section line III—III in FIG. 2. The annular form enables the device to be positioned over the neck of a cathode ray tube, not shown. The inside diameter of the focusing device is greater than the diameter of the neck of the tube to permit alignment of the focusing device on the beam. The focusing device 20 comprises a plurality of substantially cylindrical permanent magnets 1 of high thermal stability held in an annular array by a non-magnetic support piece 3 and covered at each end by flanges 2 of high magnetic permeability. There are eight magnets in the embodiment illustrated in FIGS. 1 and 2. The longitudinal axis of each magnet is substantially parallel to the neck of the tube over which the device is positioned. Suitable materials for the permanent magnets include magnetically anisotropic alloys of nickel, cobalt, aluminum and iron, having high induction remanence and specific energy, and low variation due to temperature. Examples are ALNICO 600 and ALNICO 800, available from Aimants Ugimag S.A.

An auxiliary magnetizing winding 4 is continuously and serially wound around each and every magnet 1 for magnetizing the magnets in situ, after the focusing device has been assembled. The auxiliary magnetizing winding 4 is so arranged that the respective North and South poles of the magnets 1 are located on the same side (left or right side in the sense of FIG. 2) of the assembly. The resulting magnetic fields are therefore additive, so that a resulting composite magnetic field is functionally equivalent to the magnetic field which would be generated by an annular magnet, but substantially without the aberrations resulting from magnetic anomalies, as described above. The magnets are magnetized to saturation by a capacitive discharge into the auxiliary winding, for example a current pulse on the order of 4,000 amp-turns. This procedure ensures that the same magnetic field value will be established for each magnet, because the current flowing through the auxiliary winding is the same for each magnet and produces the same magnetic field. The auxiliary magnetizing winding 4 is removed after the magnets have been magnetized as required. Focusing devices can be made in accordance with the invention which have few defects such as astigmatism and coma, which can result from a high number of magnetic poles, for example greater than 6. The composite field generated by the plurality of magnets has essentially only two poles, one North and one South.

A small auxiliary winding 5 permits optimizing adjustment of the focusing device on the screen. Auxiliary winding 5 is energized by a direct current of low value. Another auxiliary winding 6 is disposed symmetrically with respect to winding 5 to permit dynamic focusing, since static focusing can be obtained only in the center of the screen, due to the non-sphericity of the screen. Auxiliary winding 6 is energized by a parabolic current which varies according to the instantaneous position of the beam on the screen to permit adjustment the focusing on the entire screen. The various windings are mounted in grooves formed in a nonconductive, for example plastic, piece 7 for centering the flanges 2 and the magnet support piece 3.

The modular design of the focusing device enables the magnetic mass to be varied with relative ease by varying the number of magnets 1, the length of the magnets 1, or both. Maintaining a constant cylindrical diameter of the magnets 1 enables the same support pieces and auxiliary windings 5 and 6 to be used with different tubes and/or different operating voltages. The design of the focusing device can easily be optimized as a function of the stresses and characteristics demanded. Spacers can be used for preventing movement of magnets in the cylindrical mounting cavities or bores of the support piece 3, if the cavities are longer than the magnets. The design also makes possible the implementation of very small focusing devices, for example, as would be appropriate for use with a tube having a neck diameter of only 14 mm.

What is claimed is:

1. A magnetic focus apparatus, comprising:

a plurality of permanent magnets, each having a longitudinal axis, each of said magnets being magnetized in the same direction and parallel to said longitudinal axis;

a non magnetic support piece for holding said magnets in an annular array at substantially equally spaced intervals in which said longitudinal axes of said magnets are substantially parallel to one another and to a central axis defined by said array, said array of magnets generating a composite magnetic field which is undisturbed by said non magnetic support piece;

annular members of high magnetic permeability disposed over longitudinally opposite ends of said magnets; and, at least one annular winding disposed substantially adjacent to said support piece and said array of said magnets.

2. A magnetic focus apparatus, comprising:

a plurality of permanent magnets, each having a longitudinal axis, each of said magnets being magnetized in the same direction and parallel to said longitudinal axis;

means for holding said magnets in an annular array at substantially equally spaced intervals in which said longitudinal axes of said magnets are substantially parallel to one another and to a central axis defined by said array;

annular flanges of high magnetic permeability disposed over longitudinally opposite ends of said magnets;

at least one annular winding disposed substantially adjacent to from and inwardly from said array of said magnet; and, a removable and continuous winding surrounding each of said magnets for equally magnetizing said magnets in situ in said array.

3. A magnetic focus apparatus, comprising:

a non magnetic support piece having an annular configuration and defining a plurality of bores of a given cross section in an annular array at substantially equally spaced intervals in which longitudinal axes of said bores are substantially parallel to one another and to a central axis defined by said array, said bores being adapted for receiving different sets of permanent magnets having said given cross section but different lengths;

a plurality of permanent magnets having said given cross section and a given length, each of said magnets having a longitudinal axis and all of said magnets being magnetized in a common direction and parallel to said longitudinal axis;

annular members of high magnetic permeability disposed over longitudinally opposite ends of said magnets; and, at least one annular winding disposed substantially adjacent to said support piece and said array of said magnets.

4. A magnetic focus apparatus, comprising:

a non magnetic support piece having an annular configuration and defining a plurality of bores of a substantially circular cross section in an annular array at substantially equally spaced intervals in which longitudinal axes of said bores are substantially parallel to one another and to a central axis defined by said array, said bores being adapted for receiving different sets of permanent magnets having said substantially circular section but different lengths;

a plurality of permanent magnets having said substantially circular cross section and a given length, each of said magnets having a longitudinal axis and all of said magnets being magnetized in a common direction and parallel to said longitudinal axis;

annular members of high magnetic permeability disposed over longitudinally opposite ends of said magnets; and, at least one annular winding disposed substantially adjacent to said support piece and said array of said magnets.

* * * * *